US012778288B2

(12) United States Patent
Wang

(10) Patent No.: US 12,778,288 B2
(45) Date of Patent: Nov. 3, 2026

(54) CABINET WITH EASY-TO-ASSEMBLE/DISASSEMBLE DRAWER RAIL

(71) Applicant: CHANGSHA BAITUO IMPORT AND EXPORT CO., LTD., Changsha (CN)

(72) Inventor: Bin Wang, Changsha (CN)

(73) Assignee: CHANGSHA BAITUO IMPORT AND EXPORT CO., LTD., Changsha (CN)

( * ) Notice: Subject to any disclaimer, the term of this patent is extended or adjusted under 35 U.S.C. 154(b) by 61 days.

(21) Appl. No.: 18/657,753

(22) Filed: May 7, 2024

(65) Prior Publication Data

US 2025/0288102 A1 Sep. 18, 2025

(30) Foreign Application Priority Data

Mar. 12, 2024 (CN) ..... 202420466474.4

(51) Int. Cl.
*A47B 88/423* (2017.01)
*A47B 88/407* (2017.01)

(52) U.S. Cl.
CPC ..... *A47B 88/407* (2017.01)

(58) Field of Classification Search
CPC ..... A47B 88/40; A47B 88/407; A47B 88/423
USPC ..... 312/334.1, 334.7, 334.27, 265.1, 265.2, 312/265.3, 265.4
See application file for complete search history.

(56) References Cited

U.S. PATENT DOCUMENTS 2,606,091 A * 8/1952 Marion ..... A47B 88/483 384/908
3,110,536 A * 11/1963 Costantini ..... A47B 57/425 312/351
3,194,408 A * 7/1965 Kimpton ..... A47B 57/402 211/183
3,199,683 A * 8/1965 Graswich ..... A47B 57/425 211/208
3,465,895 A * 9/1969 Hyman ..... A47B 57/402 403/353
3,572,874 A * 3/1971 Hassel ..... A47B 88/43 312/257.1
3,848,942 A * 11/1974 Fanini ..... A47B 87/02 312/265.5
4,129,279 A * 12/1978 Burkholder ..... A01K 31/17 248/165

(Continued)

*Primary Examiner* — James O Hansen
(74) *Attorney, Agent, or Firm* — Hemisphere Law, PLLC

(57) ABSTRACT

A cabinet with an easy-to-assemble/disassemble drawer rail includes a frame, a plurality of pairs of guide rails, and a plurality of drawers. The plurality of pairs of guide rails are clamped to the frame. Each of the drawers is slidably connected to a pair of guide rails. The frame is provided with a plurality of pairs of mounting holes, and each of the guide rails is provided with a pair of T-shaped inserts. One pair of mounting holes and one pair of T-shaped inserts are clamped in a one-to-one correspondence. The clamping method makes it easy to assemble and disassemble the plurality of pairs of guide rails on the frame, simplifying the assembly and disassembly process of the guide rails and effectively improving the assembly efficiency of the cabinet. In addition, in case that the guide rail is damaged, it can be disassembled in a targeted manner for repair.

6 Claims, 5 Drawing Sheets

(56) References Cited

U.S. PATENT DOCUMENTS

| | | | | | |
|---|---|---|---|---|---|
| 4,191,436 | A * | 3/1980 | Cherry | E05B 65/46 | 312/333 |
| 4,575,164 | A * | 3/1986 | Pinnow | A47B 57/404 | 211/126.15 |
| 4,681,381 | A * | 7/1987 | Sevey | A47B 88/43 | 312/334.47 |
| 4,729,484 | A * | 3/1988 | McConnell | A47B 57/402 | 211/183 |
| 5,632,542 | A * | 5/1997 | Krivec | A47B 88/427 | 403/294 |
| 6,945,617 | B2 * | 9/2005 | Wong | A47B 88/44 | 312/334.1 |
| 8,646,618 | B2 * | 2/2014 | Peota | F16B 12/50 | 211/186 |
| 2005/0127802 | A1 * | 6/2005 | Chen | A47B 88/407 | 312/265.4 |

* cited by examiner

CABINET WITH EASY-TO-ASSEMBLE/DISASSEMBLE DRAWER RAIL

CROSS REFERENCE TO THE RELATED APPLICATIONS

This application is based upon and claims priority to Chinese Patent Application No. 202420466474.4, filed on Mar. 12, 2024, the entire contents of which are incorporated herein by reference.

TECHNICAL FIELD

The present disclosure relates to the technical field of cabinets, and in particular to a cabinet with an easy-to-assemble/disassemble drawer rail.

BACKGROUND

As a common household item, cabinets greatly facilitate users' storage. Typically, a cabinet includes a frame and a plurality of pullout drawers, and the plurality of pullout drawers are provided inside the frame to store items.

The frame is provided with guide rails, and the drawer slides on a pair of guide rails. Traditional guide rails are welded to the frame and cannot be disassembled for repair. When the guide rail or drawer is damaged, it is often necessary to replace the entire cabinet, resulting in poor user experience. The guide rails can also be threaded to the frame, but due to the large number of guide rails provided on the frame, it is usually cumbersome to assemble and disassemble the guide rails, resulting in a large workload for cabinet assembling.

SUMMARY

(I) Technical Problem to be Solved

In view of the above shortcomings and deficiencies in the prior art, the present disclosure provides a cabinet with an easy-to-assemble/disassemble drawer rail. The present disclosure solves the problem of cumbersome assembly and disassembly for the guide rails of a cabinet.

(II) Technical Solution

In order to achieve the objective, the present disclosure provides a cabinet with an easy-to-assemble/disassemble drawer rail. The cabinet includes a frame, a plurality of pairs of guide rails, and a plurality of drawers, where

- the plurality of pairs of guide rails are clamped to the frame;
- each of the drawers is slidably connected to a pair of guide rails; and
- the frame is provided with a plurality of pairs of mounting holes; each of the guide rails is provided with a pair of T-shaped inserts; and one pair of mounting holes and one pair of T-shaped inserts are clamped in a one-to-one correspondence.

Optionally, the T-shaped insert includes a connecting element, a first clamping element, and a second clamping element;

- a top end of the connecting element is connected to the guide rail;

- the first clamping element and the second clamping element are connected to two sides of the connecting element in a one-to-one correspondence; and
- a length of the first clamping element is greater than a length of the second clamping element.

Optionally, a thickness of the second clamping element is greater than a thickness of the first clamping element; and

- a side of the second clamping element facing the guide rail is provided with a first chamfer, and a side of the second clamping element facing away from the guide rail is provided with a second chamfer.

Optionally, a distance between an end of the first chamfer adjacent to the guide rail and the guide rail is D1, a distance between an end of the second chamfer away from the guide rail and the guide rail is D2, and a distance between a top surface of the first clamping element and the guide rail is D3; and D3 is greater than D1 and less than D2.

Optionally, the guide rail includes a first guide plate, a second guide plate, and a baffle plate;

- the first guide plate and the second guide plate are connected vertically;
- both the first guide plate and the second guide plate are connected vertically to the baffle plate;
- the pair of T-shaped inserts is provided on the second guide plate; and
- the first guide plate and the second guide plate are slidably connected to the drawer; and the drawer abuts against the baffle plate.

Optionally, the guide rail further includes a reinforcing rib; and

- a top end of the reinforcing rib is connected to the first guide plate, and a side end of the reinforcing rib abuts against the frame.

Optionally, the frame includes a top panel, a plurality of vertical posts, a plurality of cross beams, and a plurality of foot pads;

- the plurality of vertical posts are parallel to a vertical direction; the plurality of cross beams are parallel to a horizontal direction; and the vertical posts are connected vertically to the cross beams;
- the foot pads are respectively provided at bottom ends of the vertical posts;
- the top panel is provided at top ends of the plurality of vertical posts; and
- the vertical posts are respectively provided with the mounting holes.

Optionally, the foot pad includes a threaded rod and a base plate that are vertically connected; and

- the threaded rod is threaded to the vertical post.

Optionally, the frame further includes a plurality of crossing ribs; and

- free ends of the crossing ribs are connected to the vertical posts.

(III) Beneficial Effects

The present disclosure has the following beneficial effects.

The pair of guide rails includes two types, a left guide rail and a right guide rail. For the same type of guide rails, the shape and size are consistent, but the mounting positions can be replaced, effectively simplifying the mounting process of the plurality of pairs of guide rails, and also facilitating the early packaging and shipping as well as later replacement and maintenance.

Each of the guide rails is provided with a pair of T-shaped inserts. The pair of T-shaped inserts is correspondingly engaged in a pair of mounting holes to complete the mounting of the guide rails, allowing the drawer to slide on the pair of guide rails. The clamping method makes it easy to assemble and disassemble the plurality of pairs of guide rails on the frame, simplifying the assembly and disassembly process of the guide rails and effectively improving the assembly efficiency of the cabinet. In addition, in case that the guide rail is damaged, it can be disassembled in a targeted manner for repair, without the need to replace the entire cabinet.

REFERENCE NUMERALS

Figure 1:
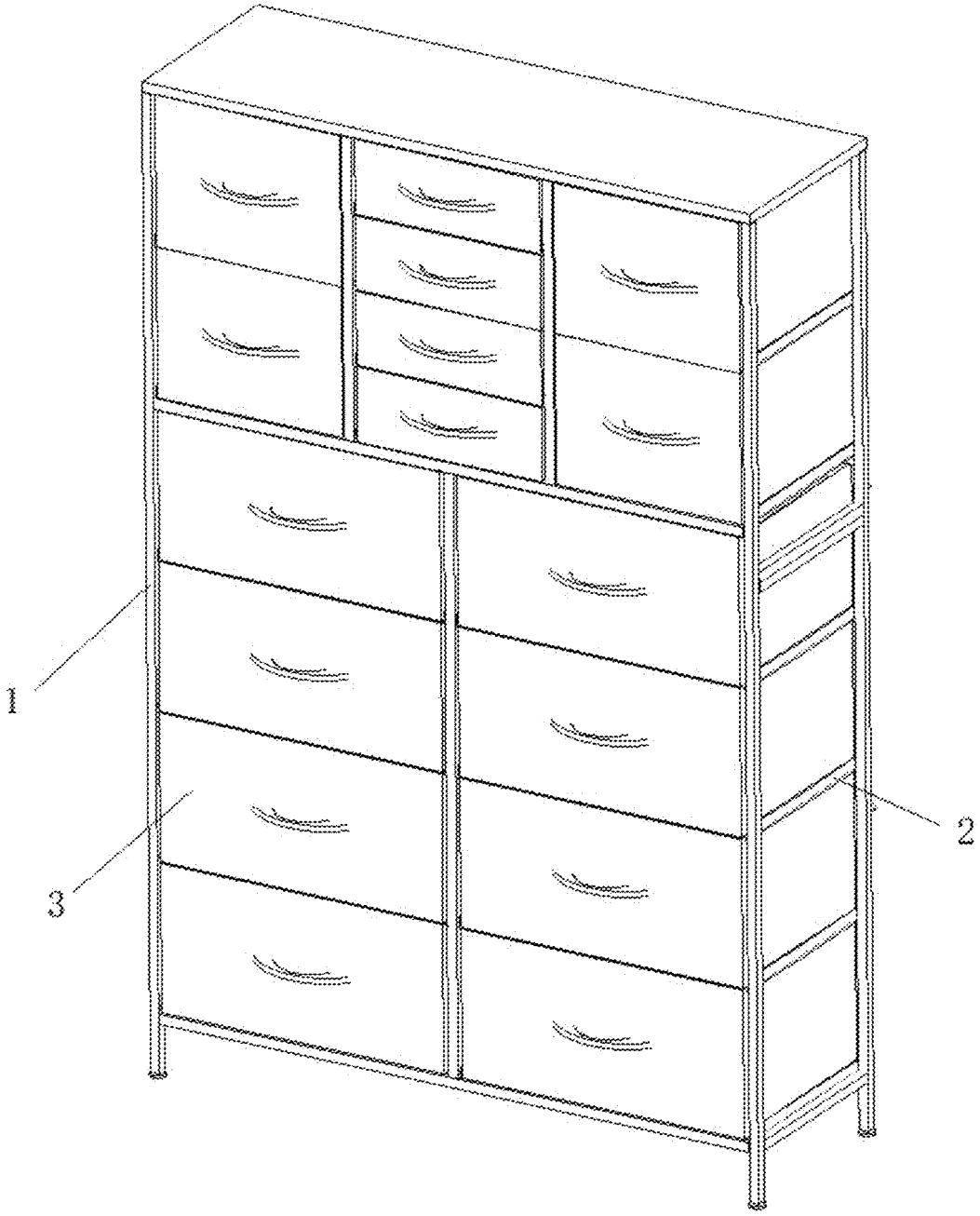
FIG. 1 is a structural diagram of a cabinet with an easy-to-assemble/disassemble drawer rail according to the present disclosure.

1. frame; 11. top panel; 12. vertical post; 13. cross beam; 14. foot pad; and 15. crossing rib;

2. guide rail; 21. first guide plate; 22. second guide plate; 23. baffle plate; and 24. reinforcing rib;

3. drawer;

4. mounting hole; and

5. T-shaped insert; 51. connecting element; 52. first clamping element; 53. second clamping element; 531. first chamfer; and 532. second chamfer.

DETAILED DESCRIPTION OF THE EMBODIMENTS

In order to better explain the present disclosure and facilitate understanding, the present disclosure is described in detail below with reference to the drawings and specific implementations.

It should be noted that all directional indications (such as up, down, left, right, front, rear . . . ) in the embodiments of the present disclosure are only used to explain relative positional relationship between various components and movement under a certain posture (as shown in the drawings). If the specific posture changes, the directional indication changes accordingly.

In addition, descriptions such as "first" and "second" in the present disclosure are only for the purpose of description, and should not be interpreted as indicating or implying their relative importance or implicitly indicating the number of indicated technical features. Therefore, features defined by "first" and "second" may explicitly or implicitly include at least one of the features. In the description of the present disclosure, "a plurality of" means at least two, for example, two or three, unless otherwise clearly and specifically limited.

In the present disclosure, unless otherwise clearly specified and limited, terms such as "connection" and "fixing" should be understood in a broad sense. For example, "fixing" may be a fixed connection, a detachable connection, or integration; and "connection" may be a mechanical connection or an electrical connection; and may be a direct connection or an indirect connection implemented by an intermediate medium, or may be internal communication between two elements or an interaction relationship between two elements, unless otherwise clearly limited. Those of ordinary skill in the art may understand the specific meanings of the above terms in the present disclosure based on specific situations.

Figure 2:
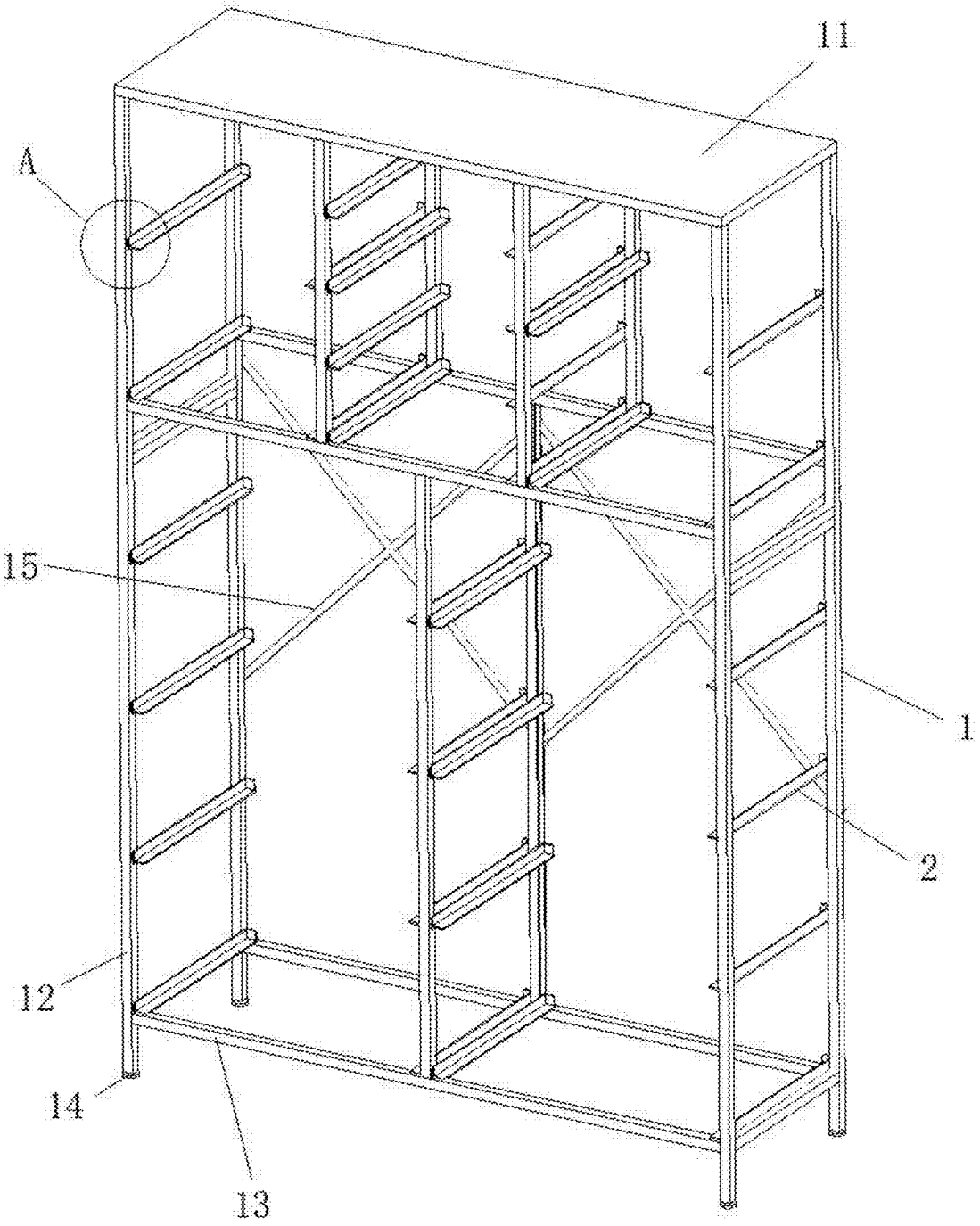
FIG. 2 is a structural diagram of a frame and guide rails that are connected according to the present disclosure.
Figure 3:
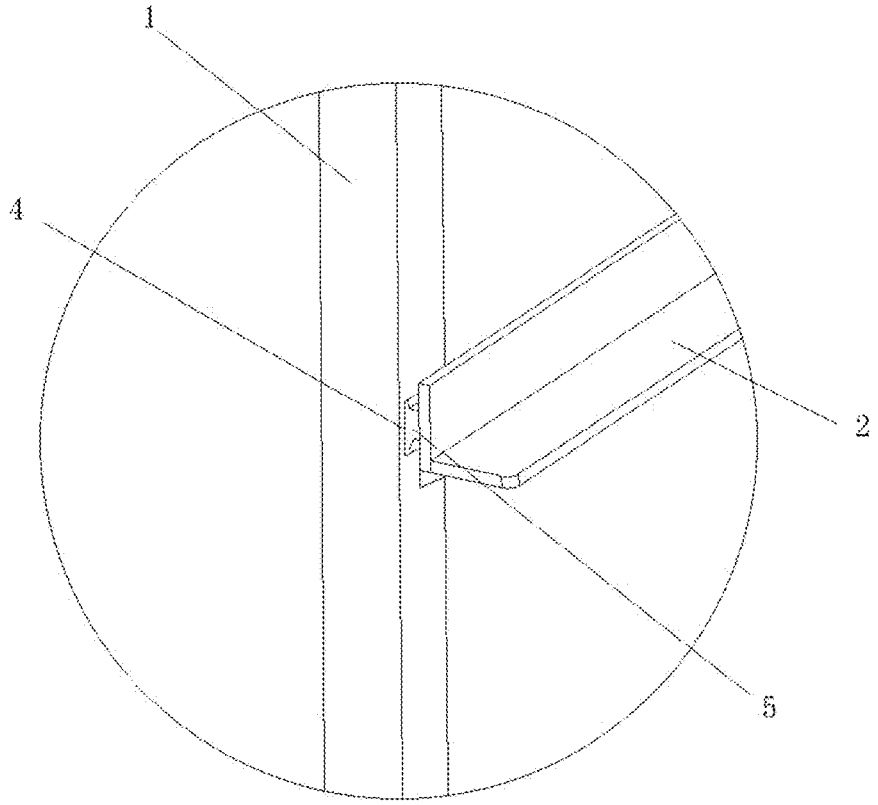
FIG. 3 is an enlarged view of A shown in FIG. 2.

As shown in FIGS. 1 to 3, the present disclosure provides a cabinet with an easy-to-assemble/disassemble drawer rail. The cabinet includes frame 1, a plurality of pairs of guide rails 2, and a plurality of drawers 3. The plurality of pairs of guide rails 2 are clamped to the frame 1. Each of the drawers 3 is slidably connected to a pair of guide rails 2. The frame 1 is provided with a plurality of pairs of mounting holes 4, and each of the guide rails 2 is provided with a pair of T-shaped inserts 5. One pair of mounting holes 4 and one pair of T-shaped inserts 5 are clamped in a one-to-one correspondence. The guide rails 2 can be plastic guide rails or metal guide rails. Similarly, the T-shaped inserts 5 can be plastic T-shaped inserts or metal T-shaped inserts. The material can be selected according to actual usage requirements.

The pair of guide rails 2 includes two types, a left guide rail and a right guide rail. For the same type of guide rails 2, the shape and size are consistent, but the mounting positions can be replaced, effectively simplifying the mounting process of the plurality of pairs of guide rails 2, and also facilitating the early packaging and shipping as well as later replacement and maintenance.

Each of the guide rails 2 is provided with a pair of T-shaped inserts 5. The pair of T-shaped inserts 5 is correspondingly engaged in a pair of mounting holes 4 to complete the mounting of the guide rails 2, allowing the drawer 3 to slide on the pair of guide rails 2. The clamping method makes it easy to assemble and disassemble the plurality of pairs of guide rails 2 on the frame 1, simplifying the assembly and disassembly process of the guide rails 2 and effectively improving the assembly efficiency of the cabinet. In addition, in case that the guide rail 2 is damaged, it can be disassembled in a targeted manner for repair, without the need to replace the entire cabinet.

Figure 4:
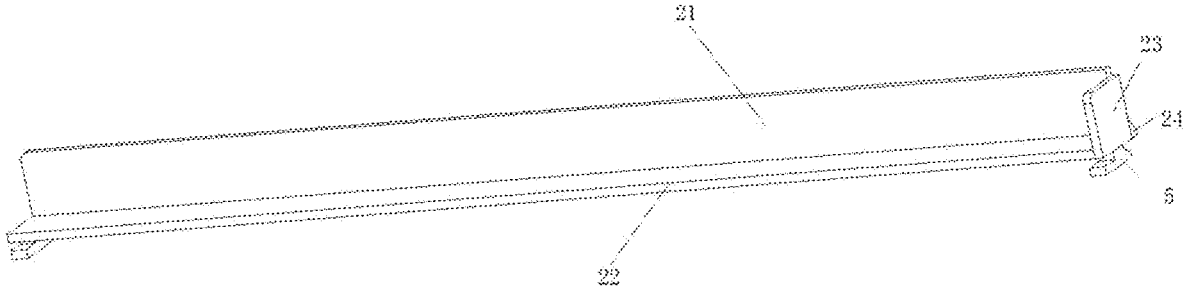
FIG. 4 is a structural diagram of the guide rail according to the present disclosure.
Figure 5:
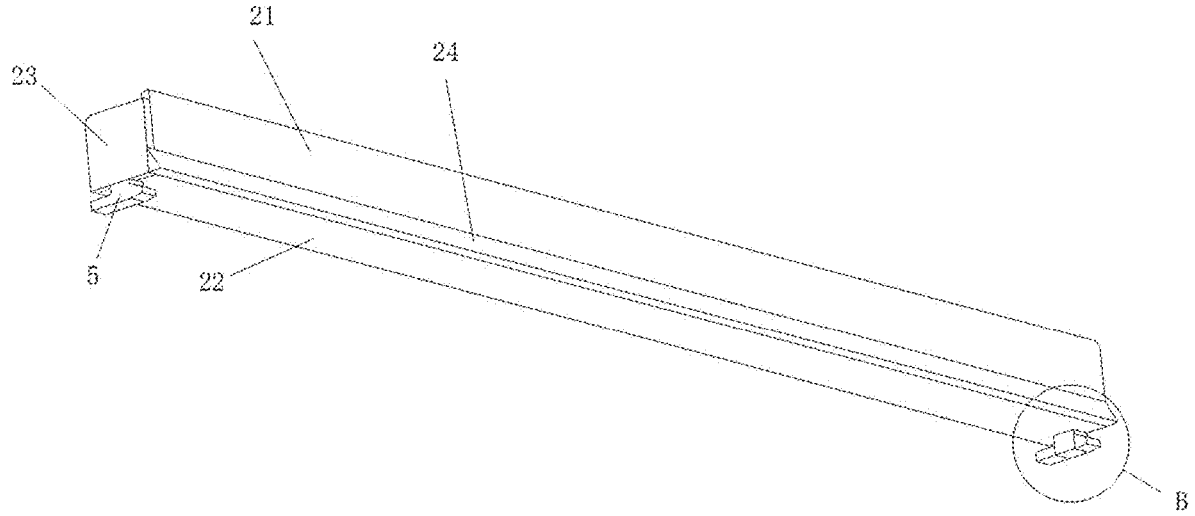
FIG. 5 is a back view of the guide rail according to the present disclosure.
Figure 6:
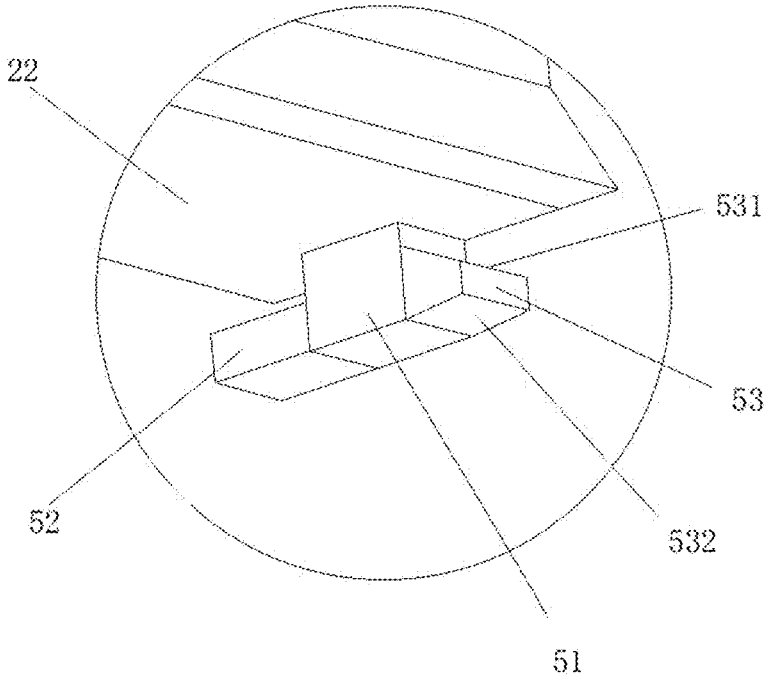
FIG. 6 is an enlarged view of B shown in FIG. 5.

As shown in FIGS. 4 to 6, the T-shaped insert 5 includes connecting element 51, first clamping element 52, and second clamping element 53. A top end of the connecting element 51 is connected to the guide rail 2. The first clamping element 52 and the second clamping element 53 are connected to two sides of the connecting element 51 in a one-to-one correspondence. A length of the first clamping element 52 is greater than that of the second clamping element 53. Preferably, the connecting element 51, the first clamping element 52, and the second clamping element 53 are integrated to simplify the structure of the cabinet. The division of the T-shaped insert 5 shown in FIG. 6 is for the purpose of facilitating the explanation of the technical solution of the present disclosure. As shown in FIG. 3, in this embodiment, the mounting hole 4, the connecting element 51, the first clamping element 52, and the second clamping element 53 are all square blocks. Through the square block structure, the T-shaped insert 5 forms a face-to-face abutment relationship with the mounting hole 4, effectively enhancing the mounting stability and load-bearing capacity of the guide rail 2. When the guide rail 2 is mounted, the longer first clamping element 52 is firstly clamped into the mounting hole 4, and then the second clamping element 53 is clamped into the mounting hole 4. The guide rail 2 is mainly borne by the connecting element 51, and the length of the first clamping element 52 is greater than that of the second clamping element 53. Therefore, after the second clamping element 53 is clamped into the mounting hole 4, the T-shaped insert 5 and the guide rail 2 will drop a certain distance until the connecting element 51 abuts against the guide rail 2. The mounting method of the T-shaped insert 5 extends the length of the second clamping element 53. Due to the sufficient length of the first clamping element 52, after the T-shaped insert 5 is fully clamped into the mounting hole 4, it effectively ensures the mounting stability of the guide rail 2 and effectively avoids the T-shaped insert 5 from falling out of the mounting hole 4.

As shown in FIG. 6, a thickness of the second clamping element 53 is greater than that of the first clamping element 52. A side of the second clamping element 53 facing the guide rail 2 is provided with first chamfer 531, and a side of the second clamping element 53 facing away from the guide rail 2 is provided with second chamfer 532. The first chamfer 531 and the second chamfer 532 play a guiding role and improve the convenience of mounting the T-shaped insert 5 into the mounting hole 4. The second chamfer 532 is used when mounting the T-shaped insert 5, and the first chamfer 531 is used when removing the T-shaped insert 5. Because the thickness of the second clamping element 53 is greater than that of the first clamping element 52, after the T-shaped insert 5 is fully clamped into the mounting hole 4, the mounting hole 4 just fits into the first chamfer 531 and a hanging corner of the connecting element 51. Therefore, each time the T-shaped insert 5 is mounted, the mounting accuracy of the guide rail 2 is ensured, ensuring that the guide rail 2 fits with the frame 1 and improving the load-bearing capacity of the guide rail 2.

Figure 7:
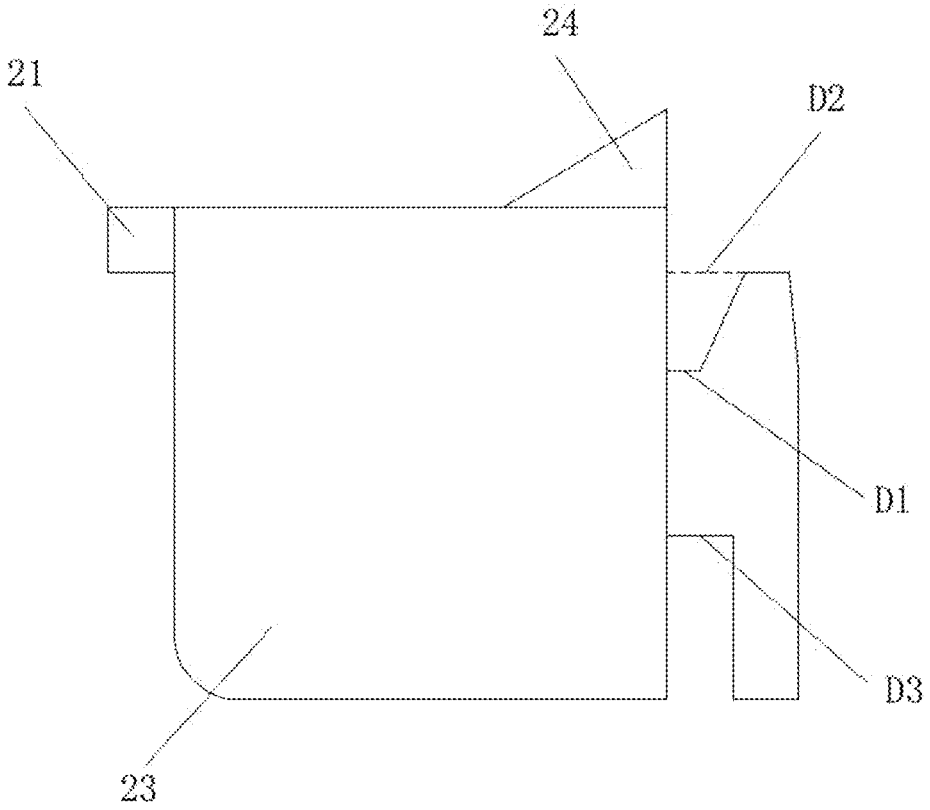
FIG. 7 is a side view of the guide rail according to the present disclosure.

As shown in FIG. 7, a distance between an end of the first chamfer 531 adjacent to the guide rail 2 and the guide rail 2 is D1, a distance between an end of the second chamfer 532 away from the guide rail 2 and the guide rail 2 is D2, and a distance between a top surface of the first clamping element 52 and the guide rail 2 is D3. D3 is greater than D1 and less than D2. Specifically, when the T-shaped insert 5 is mounted, the first clamping element 52 is firstly clamped into the mounting hole 4, and then the second chamfer 532 abuts against the mounting hole 4. Finally, the guide rail 2 is pushed such that the second clamping element 53 is clamped into the mounting hole 4. It should be noted that, taking the orientation shown in FIG. 3 as an example, since D3 is greater than D1, when the T-shaped insert 5 is fully clamped into the mounting hole 4, a bottom end of the connecting element 51 abuts against the mounting hole 4, and there is a certain gap between the first clamping element 52 and the frame 1. Therefore, when the T-shaped insert 5 is disassembled, the guide rail 2 can be raised vertically first to make the top end of the connecting element 51 abut against the mounting hole 4, and then the guide rail 2 is horizontally moved to make the first clamping element 52 abut against the frame 1. This shortens the length of the second clamping element 53, and also shortens the displacement of the first chamfer 531 out of the mounting hole 4, improving the ease of disassembling the T-shaped insert 5. The mounting of the T-shaped insert 5 is similar and will not be further described.

As shown in FIGS. 4 and 5, the guide rail 2 includes first guide plate 21, second guide plate 22, and baffle plate 23. The first guide plate 21 and the second guide plate 22 are connected vertically. Both the first guide plate 21 and the second guide plate 22 are connected vertically to the baffle plate 23. The pair of T-shaped inserts 5 is provided on the second guide plate 22. The first guide plate 21 and the second guide plate 22 are slidably connected to the drawer 3. The drawer 3 abuts against the baffle plate 23. Specifically, when closing the drawer 3, the drawer 3 is pushed from a side away from the baffle plate 23 until the drawer 3 abuts against the baffle plate 23, thus completing the retraction of the drawer 3. There is no need to provide an additional back panel for the frame 1, effectively reducing the weight of the frame 1. The guide rail 2 is supported by the connecting element 51, and guided by an L-shaped slide formed by the first guide plate 21 and the second guide plate 22. The retraction position of the drawer 3 is limited by the baffle plate 23. The self-weight of the guide rail 2 and the pressure applied by the drawer 3 effectively ensure the mounting stability of the guide rail 2.

The guide rail 2 further includes reinforcing rib 24. A top end of the reinforcing rib 24 is connected to the first guide plate 21, and a side end of the reinforcing rib 24 abuts against the frame 1. In this embodiment, the reinforcing rib 24 is a triangular prism, although it can also be a reinforcing rib in an L-shape or other shape. One right-angle edge of the triangular prism is connected to the first guide plate 21, and the other right-angle edge of the triangular prism is abuts against the frame 1. The triangular prism can effectively transmit the force of the guide rail 2 to the frame 1, further improving the load-bearing capacity of the guide rail 2.

In addition, the frame 1 includes top panel 11, a plurality of vertical posts 12, a plurality of cross beams 13, and a plurality of foot pads 14. The plurality of vertical posts 12 are parallel to a vertical direction. The plurality of cross beams 13 are parallel to a horizontal direction. The vertical posts 12 are connected vertically to the cross beams 13. The foot pads 14 are respectively provided at bottom ends of the vertical posts 12. The foot pads 14 are non-slip pads. The top panel 11 is provided at top ends of the plurality of vertical posts 12. The vertical posts 12 are respectively provided with the mounting holes 4. Unlike traditional frames, the frame 1 in the present disclosure does not require a back panel to limit the drawer 3, but limits the drawer 3 through the baffle plate 23. Therefore, the present disclosure effectively reduces the weight of the frame 1, improves transportation convenience, and saves costs. Optionally, the vertical posts 12 and the cross beams 13 can be divided into a plurality of sections and connected by L-shaped hinges and bolts. The top panel is connected to the vertical posts 12 by bolts, such that the frame 1 can be disassembled for packaging, which eases cabinet transportation.

Further, the foot pad 14 includes a threaded rod and a base plate that are vertically connected. The threaded rod is threaded to the vertical post 12. After the frame 1 is assembled, it is usually necessary to level it. Since the threaded rod is threaded to the vertical post 12, by rotating the base plate, spacing between the vertical post 12 and the base plate can be adjusted to achieve leveling of the frame 1, improving the adaptability of the cabinet to uneven ground.

The frame 1 further includes a plurality of crossing ribs 15. Free ends of the crossing ribs 15 are connected to the vertical posts 12. The crossing ribs 15 each include two intersecting ribs. Two free ends of the ribs are threaded to the vertical posts 12. The crossing ribs 15 are provided at a back panel position of a traditional cabinet, playing a load-bearing role and effectively enhancing the load-bearing capacity of the cabinet.

It should be understood that the above description of the specific embodiments of the present disclosure is only to illustrate the technical route and characteristics of the present disclosure, and its purpose is to enable those skilled in the art to understand the content of the present disclosure and implement it accordingly. However, the present disclosure is not limited to the above-mentioned specific embodiments. Any changes or modifications made within the scope of the claims of the present disclosure shall be covered within the protection scope of the present disclosure.

The invention claimed is:

1. A cabinet comprising a frame, a plurality of pairs of guide rails, and a plurality of drawers, wherein the plurality of pairs of guide rails are clamped to the frame;

each of the plurality of drawers is slidably connected to one pair of guide rails of the plurality of pairs of guide rails; and the frame is provided with a plurality of pairs of mounting holes; each of the guide rails is provided with a pair of T-shaped inserts; and one pair of mounting holes and one pair of T-shaped inserts are clamped in a one-to-one correspondence, wherein each T-shaped insert of the pair of T-shaped inserts comprises a connecting element, a first clamping element, and a second clamping element, wherein a first side of the connecting element is connected to the first clamping element, and a second side of the connecting element opposing the first side is parallel to the first side and is connected to the second clamping element, wherein the second side of the connecting element is directly connected to a first side of the second clamping element, and an included angle between the second side of the connecting element and the first side of the second clamping element is obtuse, wherein a thickness of the second clamping element is greater than a thickness of the first clamping element, the side of the second clamping element facing the guide rail is provided with a first chamfer, and another side of the second clamping element facing away from the guide rail is provided with a second chamfer, wherein a distance between an end of the first chamfer adjacent to the guide rail and the guide rail is D1, a distance between an end of the second chamfer away from the guide rail and the guide rail is D2, and a distance between a top surface of the first clamping element and the guide rail is D3, wherein D3 is greater than D1 and less than D2.

2. The cabinet according to claim 1, wherein a top end of the connecting element is connected to the guide rail; and a length of the first clamping element is greater than a length of the second clamping element.

3. The cabinet according to claim 1, wherein each guide rail of the plurality of pairs of guide rails comprises a first guide plate, a second guide plate, and a baffle plate; the first guide plate and the second guide plate are connected vertically; both the first guide plate and the second guide plate are connected vertically to the baffle plate; the pair of T-shaped inserts is provided on the second guide plate; and the first guide plate and the second guide plate are slidably connected to a respective drawer of the plurality of drawers; and the respective drawer abuts against the baffle plate.

4. The cabinet according to claim 3, wherein each guide rail further comprises a reinforcing rib; and a top end of the reinforcing rib is connected to the first guide plate, and a side end of the reinforcing rib abuts against the frame.

5. The cabinet according to claim 1, wherein the frame comprises a top panel, a plurality of vertical posts, a plurality of cross beams, and a plurality of foot pads; the plurality of vertical posts are parallel to a vertical direction; the plurality of cross beams are parallel to a horizontal direction; and the plurality of vertical posts are connected vertically to the plurality of cross beams; the plurality of foot pads are respectively provided at bottom ends of the plurality of vertical posts; the top panel is provided at top ends of the plurality of vertical posts; and the plurality of vertical posts are respectively provided with the plurality of pairs of mounting holes.

6. The cabinet according to claim 5, wherein the frame further comprises a plurality of crossing ribs; and free ends of the plurality of crossing ribs are connected to the plurality of vertical posts.

* * * * *